US005375681A

United States Patent [19]

Eickmann

[11] Patent Number: 5,375,681

[45] Date of Patent: Dec. 27, 1994

[54] LIFTING DEVICE AND STROKE MULTIPLIER

[76] Inventor: Karl Eickmann, 2420 Isshiki, Hayama-machi, Kanagawa-ken, Japan

[21] Appl. No.: 49,387

[22] Filed: Apr. 21, 1993

[30] Foreign Application Priority Data

Aug. 5, 1992 [DE] Germany ..... 4225871

[51] Int. Cl.[5] ..... B66B 11/04

[52] U.S. Cl. ..... 187/237; 254/122

[58] Field of Search ..... 187/18, 8.71; 254/122, 254/93 R; 182/141

[56] References Cited

U.S. PATENT DOCUMENTS

| | | | |
|---|---|---|---|
| 12,675 | 4/1855 | Eames | 187/18 |
| 3,476,016 | 11/1969 | Dixon et al. | 187/18 |
| 3,486,583 | 12/1969 | Wiklund | 187/18 |
| 5,215,287 | 6/1993 | Leski | 254/122 |

*Primary Examiner*—Kenneth W. Noland

[57] ABSTRACT

The present invention overcomes existing problems by the provision of a lifting device below the lowest shanks and endwards of the platform. The lift stroke of the highest scissor obtains thereby a many times longer stroke relative to the very short stroke of the lifting device. In another preferred arrangement of the invention, two columns of scissors are mounted parallel laterally of each other for synchronized operation. The highest scissor-shanks then connect to top arms which bear holder shafts on which holders are kept to extend downwards from the holder shafts. The holders then carry on their lower ends the platform, whereby the platform can become sank down for meeting the level of the ground for an easy loading of the platform. The holders with the platform can become replaced by a cabin. The lifting device of the invention requires thereby only small space for instalment in a house or a hall. Since the device of the invention is "self-holding", a structure to hold or guide the lift is not necessary and the lift of the invention can therefore be applied also in wooden houses or halls.

4 Claims, 11 Drawing Sheets

LIFTING DEVICE AND STROKE MULTIPLIER

BACKGROUND OF THE INVENTION

1.) Field of the Invention

This invention relates to lifts or elevators and more in part to combined scissor-lifter devices, in which lifters, for example, fluid operated pistons, drive and sink the shanks of the scissors.

2.) Description of the Prior Art

A typical scissor-lifter combination of the field of the invention is described, for example, in the U.S. Pat. No. 3,486,583 which is granted to G. WIKLUND. It shows shanks 5 and 6 or 2 and 3 connected by a scissor connecter 11 to form a scissor. On top of the mentioned scissor(s) a platform 14 is mounted. The lifting pistons are located below the medial portions of the scissor shanks, but the lower ends of the lowest shanks engage the base plate and the Wiklund lift therefore requires a space below the base face for the location of a portion of the lifter below the base face.

A typical car-lift is also shown in U.S. Pat. No. 5,012,898. It shows the lifting pistons between the shanks, but not below them. The platform 10 is again located above the shanks 11,12 and requires inclined guide ways to make it possible to load the not fully down sinkable platform.

The so known lifting devices have the described disadventages and a novel invention is therefore required to overcome them and to provide a novel lifting device which requires a smaller space for its installation, while at the same time it can sink the platform fully down to the ground and which also obtains a higher lifting stroke.

EXPLANATION AND DEFINITION OF TERMS WHICH ARE USED IN THIS APPLICATION

"The term "scissor" in this application defines two medially swingably connected shanks (arms) which are on their ends provided with connection means for the connection to other members, for example, to other scissor-shanks. Such shanks then have the basic configuration of a scissor or of a pantaloon (hoses suspenser), but do not act for cutting of material or for carrying the hose of a man, but act in this application for a lifting purpose. The term "scissor" is used in this application, because an exact term for the mentioned swingably connected shanks is presently not known in common language. Neither in Japanese (where the term "HASAMI" may be close), nor in the english or german languages."

SUMMARY OF THE INVENTION

The invention obtains its aim or its aims by the application of at least one or by the application of a plurality of the objects of the invention.

The first object of the invention is the provision of bottom-most swing arms which are swingably borne on holders of a base-face to swingably connect to the outer ends of the lowest shanks of at least one scissor, wherein the scissor is formed by a medial scissor connection which swingably connects two shanks of the respective scissor, while a lifting device is provided between the base face and the lowest shanks of the lowest scissor.

The second object of the invention is to secure an economic and safe functioning of the operation of the scissors thereby, that the lowest outer swing connectors of the lawest scissor form first distances and second distances from each other, at their lowest and highest locations, respectively, during their strokes, with the first distances being larger than the second distances, and that the holders on the base face are located between the vertical projections of the first and second distances and the lifting device is located with its foot in the middle between the mentioned holders to remain at all times in the middle of the vertical projections of the mentioned first and second distances. (i.e. FIGS. 17 and 18.)

The second object of the invention is the arrangement of a pair or a pair of sets of scissors lateral of each other and parallel to each other for the provision of top arms on the highest shanks to provide holding shafts on the top arms for the holding of therefrom downwards extended holders which carry on their lower ends the platform.

The third object of the invention is the provision of swing-arms which are pivotable retained between the base face and the lowest shank connecters of the lowest scissor(s).

The fourth object of the invention is the application of a lifter between the base face and the medial scissor connecter of the lowest scissor.

The fifth object of the invention is to provide the lifter with a head face and the lowest shanks with thrust obtainers or rollers between the outer ends and the medial scissor connecter of the lowest shank(s) and scissor(s) in order that the lifter acts against the lowest shank at a location between the middle and the ends of the respective shank, whereby an elongated stroke of the lowest shanks is obtained.

The seventh object of the invention is the provision of synchronizers which effect the equality of strokes of the lifting devices of the third object of the invention to equal lengths of strokes at equal times.

The eighth object of the invention is to use as lifting devices non-corroding material pistons in cylinders and common water as the driving fluid which enters and exits the mentioned cylinders for effecting the lifting strokes of the pistons in the cylinders.

The nineth object of the invention is the provision of a stroke-multiplying apparatus of the first object of the invention, in which a plurality of scissors multiply on their highest ends the stroke of the mentioned lifting device.

And, the tenth object of the invention is the provision of safety—and/or speed varying devives to the shanks or lifting device.

These and more objects of the invention will become understood by the description of the preferred embodiments and by the appended claims of the present invention.

Figure 1:
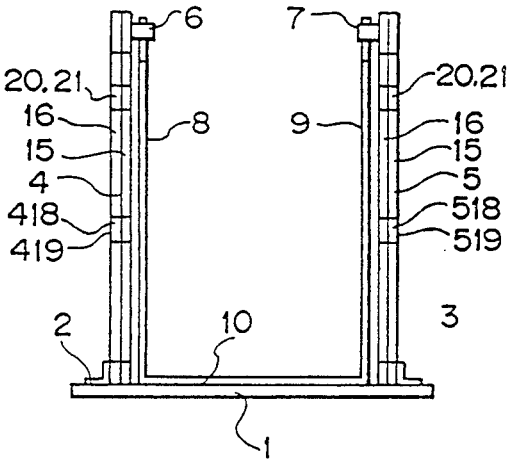

More in detail,

FIG. 1 is a view onto a scissor lift assembly of the invention.

Figure 2:
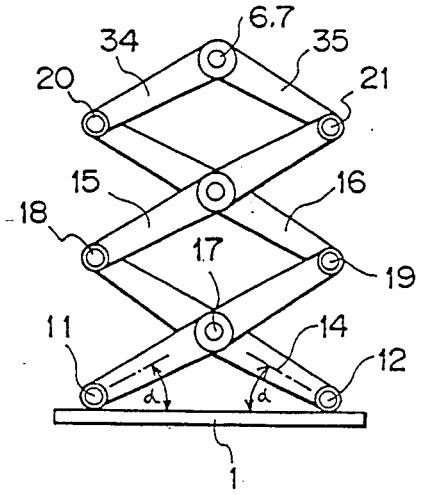
FIGS. 1 to 42 are views onto embodiments of the invention or of parts thereof, partially also in sectional views.
Figure 4:
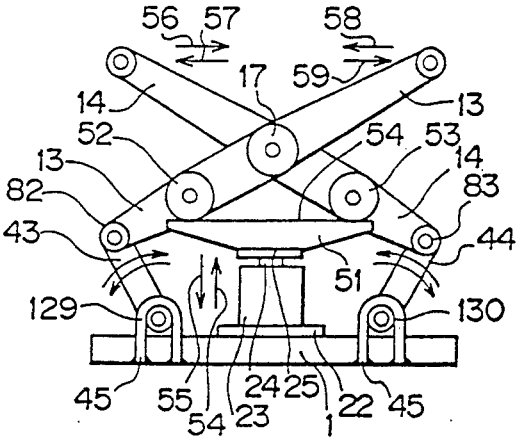

FIG. 2 is a view from the side onto the scissor lift assembly of FIG. 4.

Figure 3:
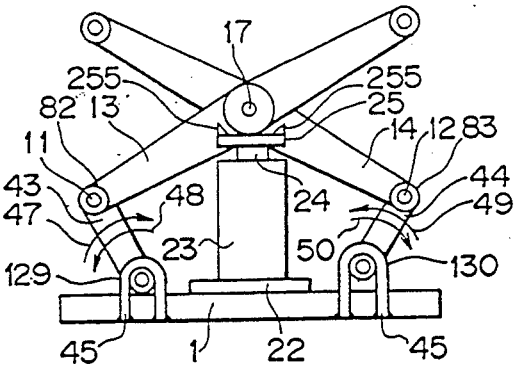

FIGS. 3 and 4 illustrate members between the ground the scissors.

Figure 5:
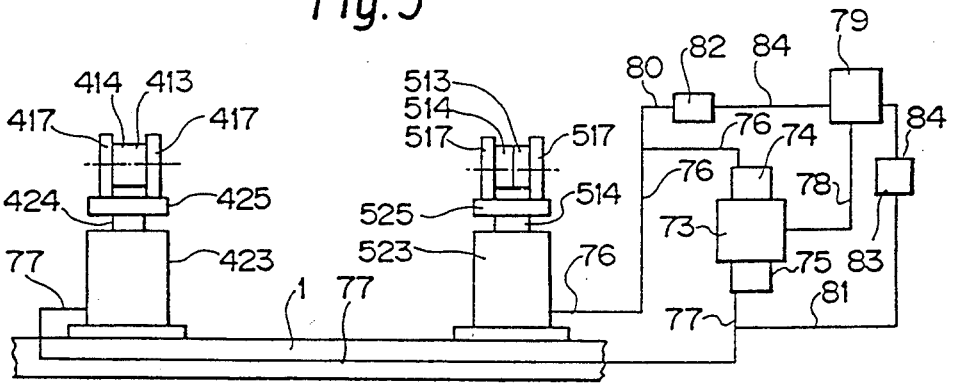

FIG. 5 is a schematic which illustrates a synchronized drive to lifters.

Figure 6:
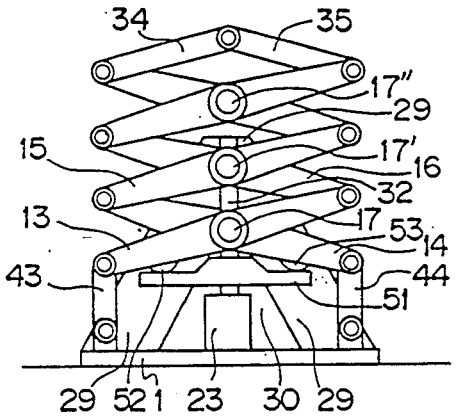
Figure 7:
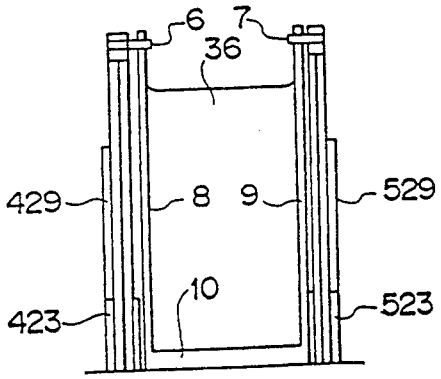

FIG. 6 is a view from the side onto FIG. 7.

FIG. 7 shows a lift with a platform between scissor sets.

Figure 8:
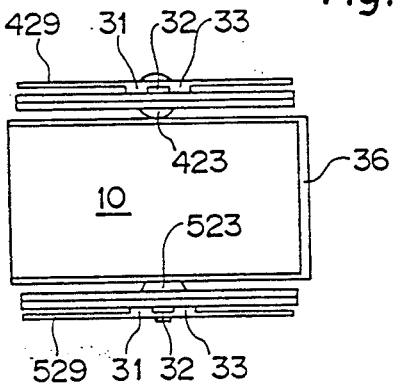

FIG. 8 is a view onto FIG. 6 from the above.

Figure 9:
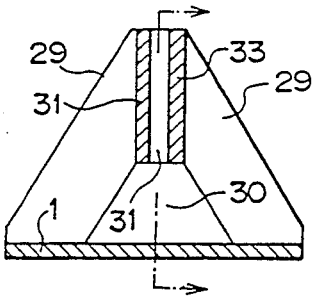
Figure 10:
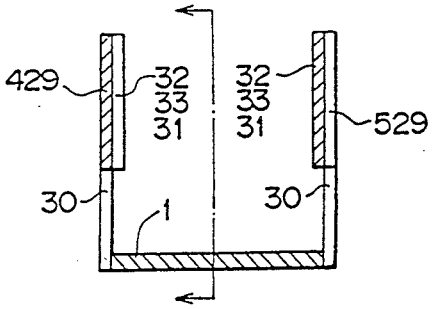
Figure 11:
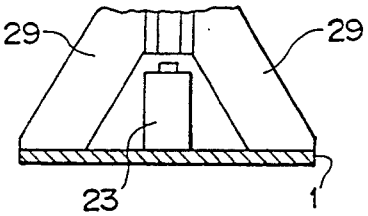
Figure 12:
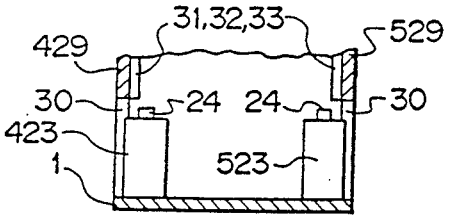

FIGS. 9 and 10 are sectional views of each other, while FIGS. 11 and 12 are also sectional views of each other with FIGS. 9 to 12 showing details of the lower portions of FIGS. 6 and 7.

Figure 14:
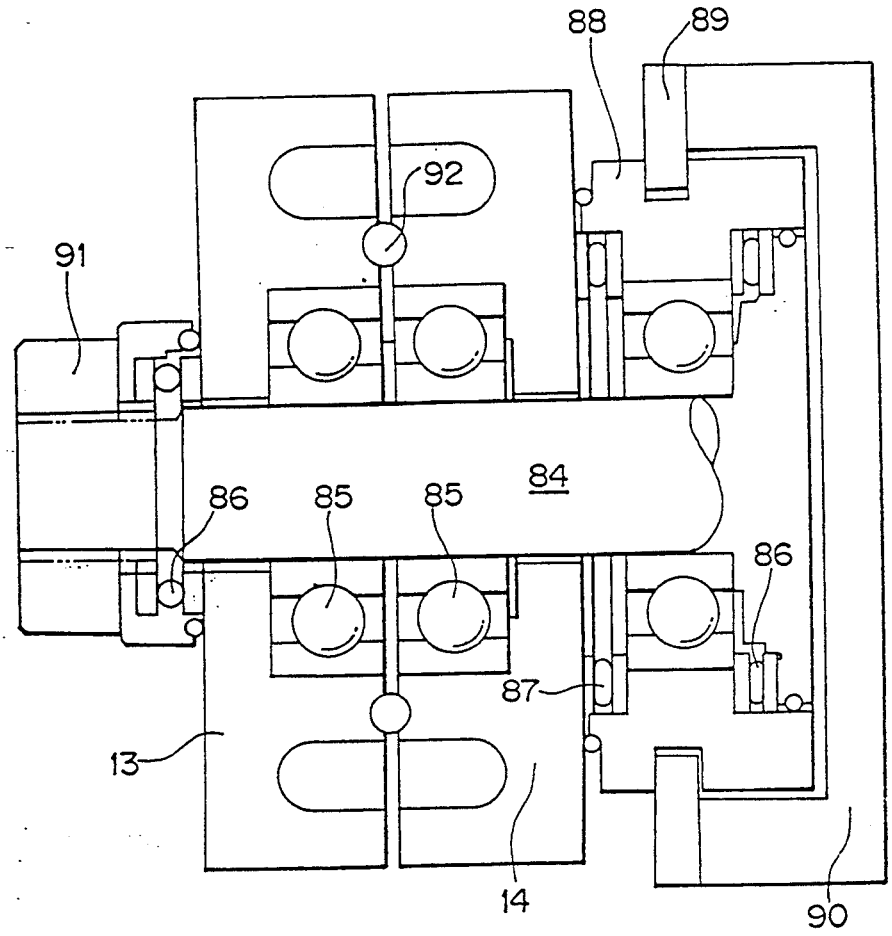
Figure 13:
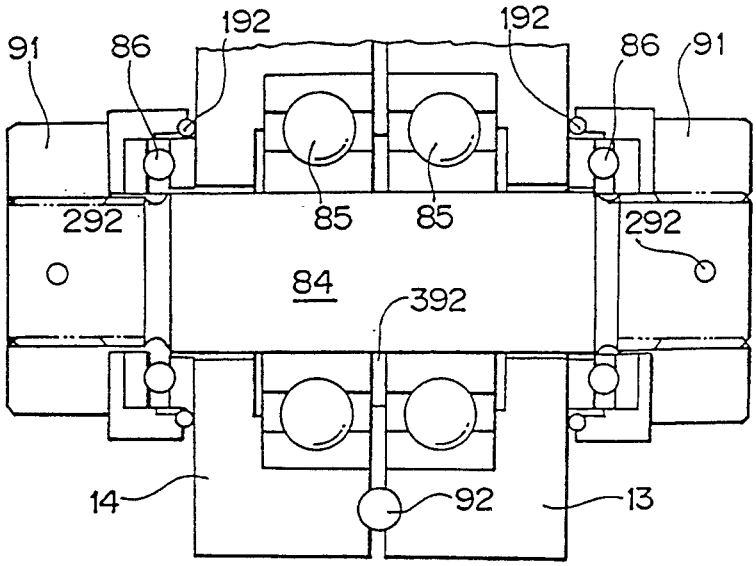

FIGS. 13 and 14 are sectional arrangements through connecters for shanks.

Figure 16:
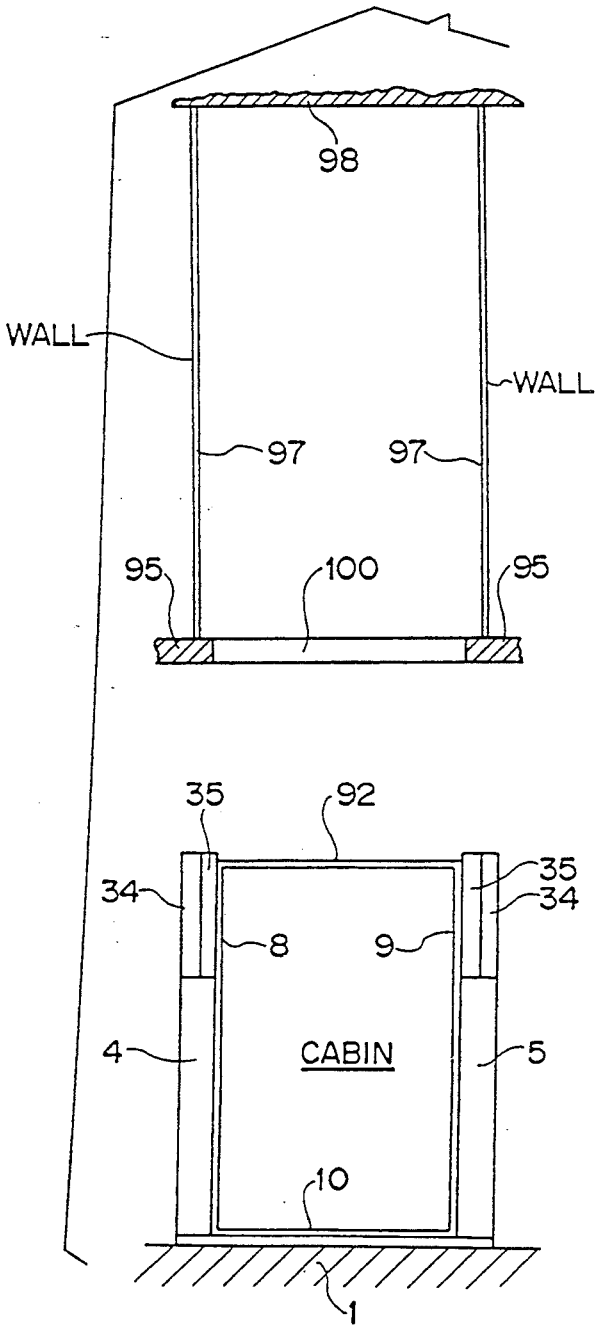
Figure 15:
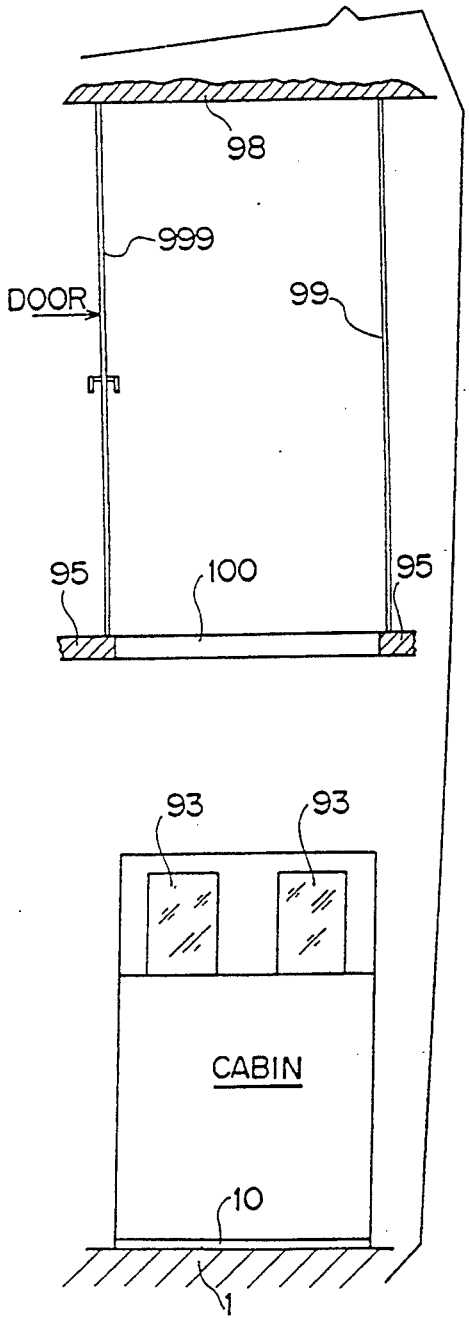

FIGS. 15 and 16 show a ground floor and upper floor seen 90 degrees turned relative to each other.

Figure 17:
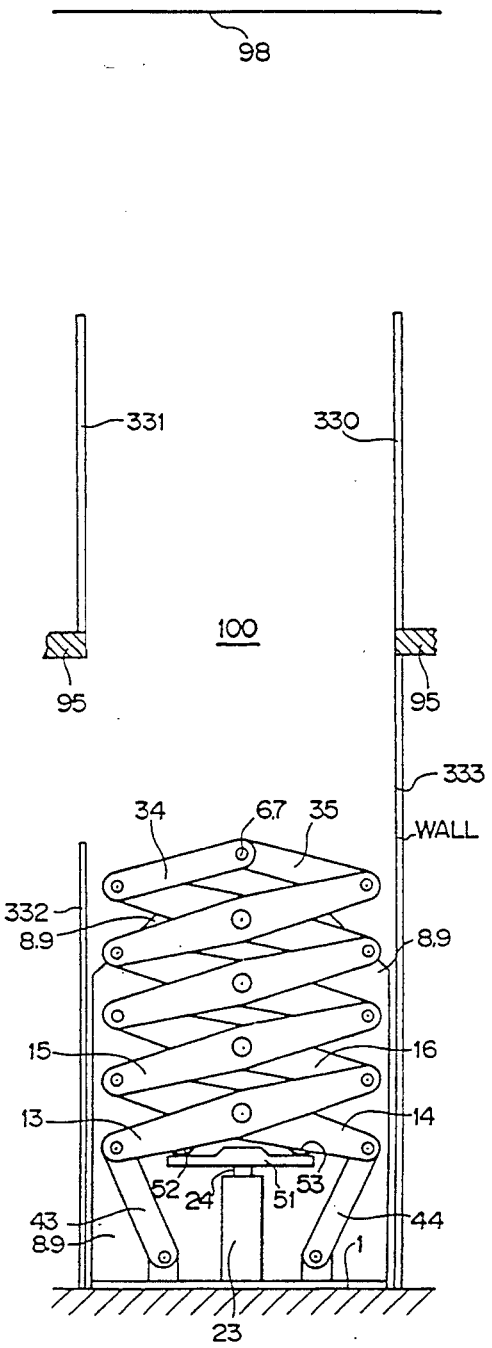
Figure 18:
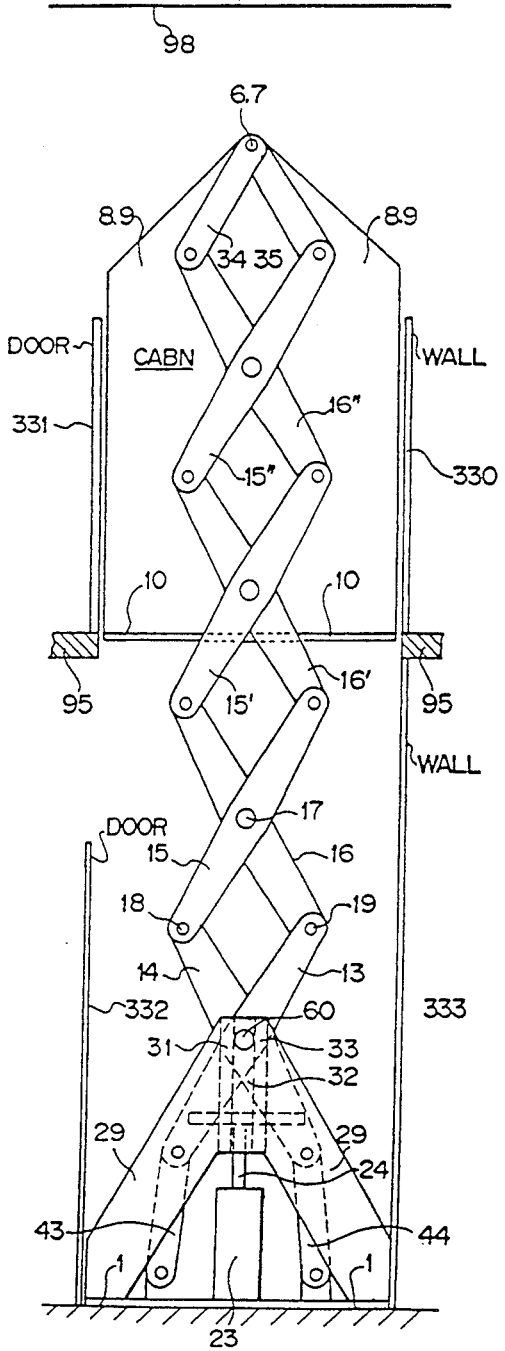

FIG. 17 shows a lift in its lowest location, while FIG. 18 shows the same lift in its highest location.

Figure 19:
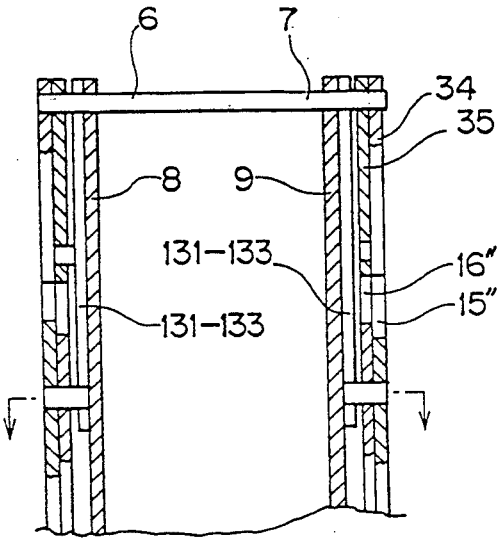
Figure 20:
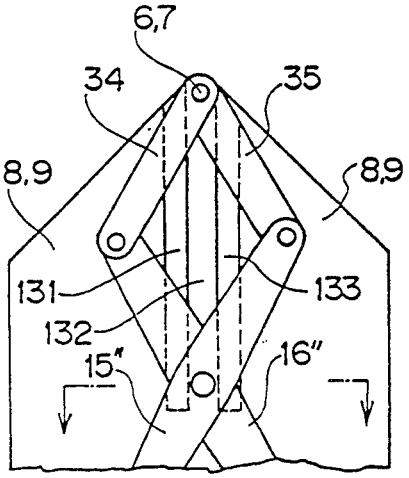
Figure 21:
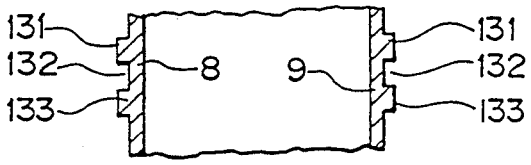
Figure 22:
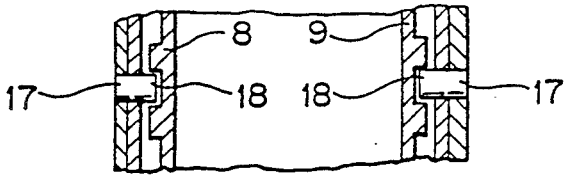

FIG. 19 is a sectional view through an upper portion of the invention, while FIG. 20 is a view from the side onto FIG. 19 and FIGS. 21 to 22 illustrate portions of FIG. 19.

Figure 23:
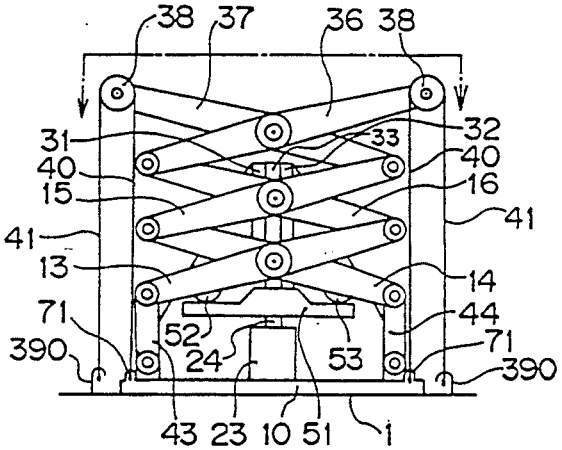
Figure 24:
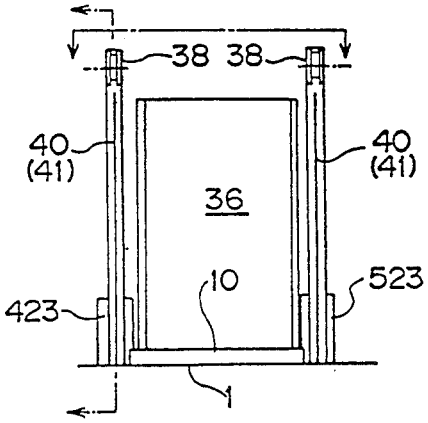
Figure 25:
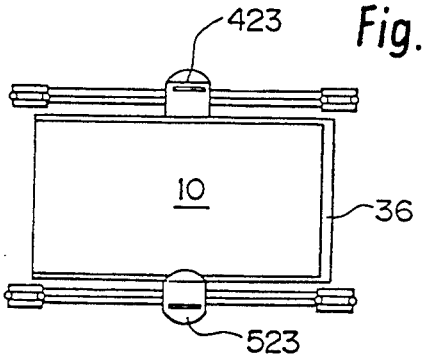
Figure 26:
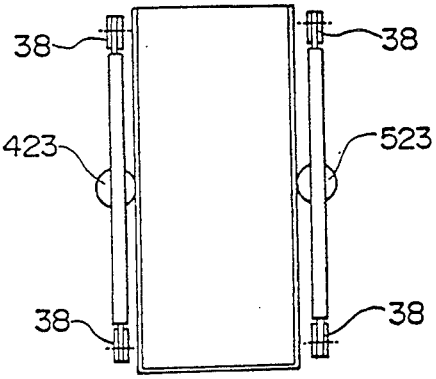
Figure 27:
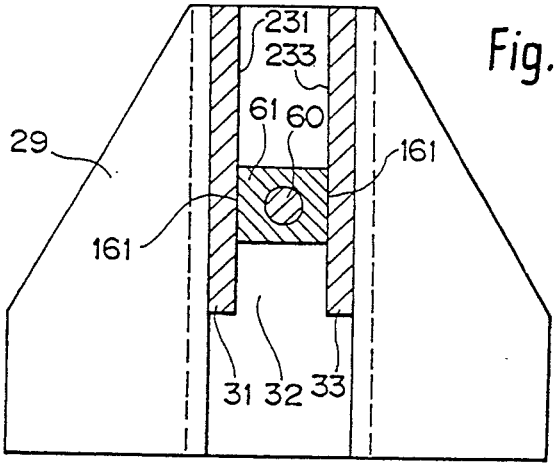
Figure 28:
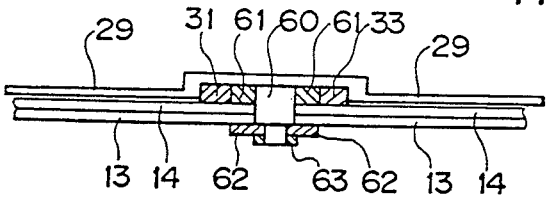
Figure 29:
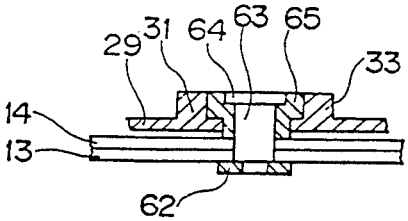

FIG. 23 illustrates another device of the invention, with FIGS. 22 to 26 different views of it and FIG. 27 showing details of FIG. 23 with FIGS. 28 to 29 showing details of FIG. 27.

Figure 30:
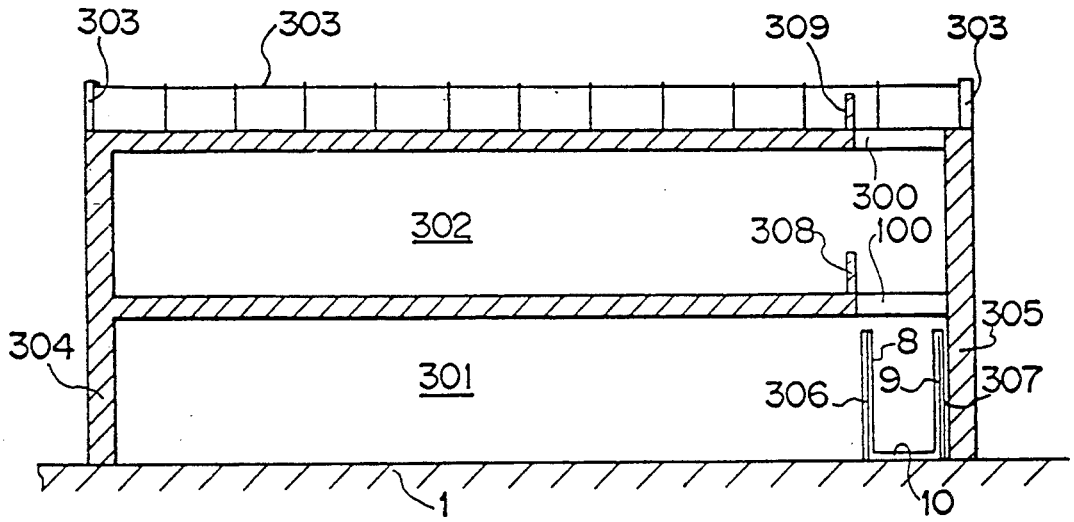
Figure 31:
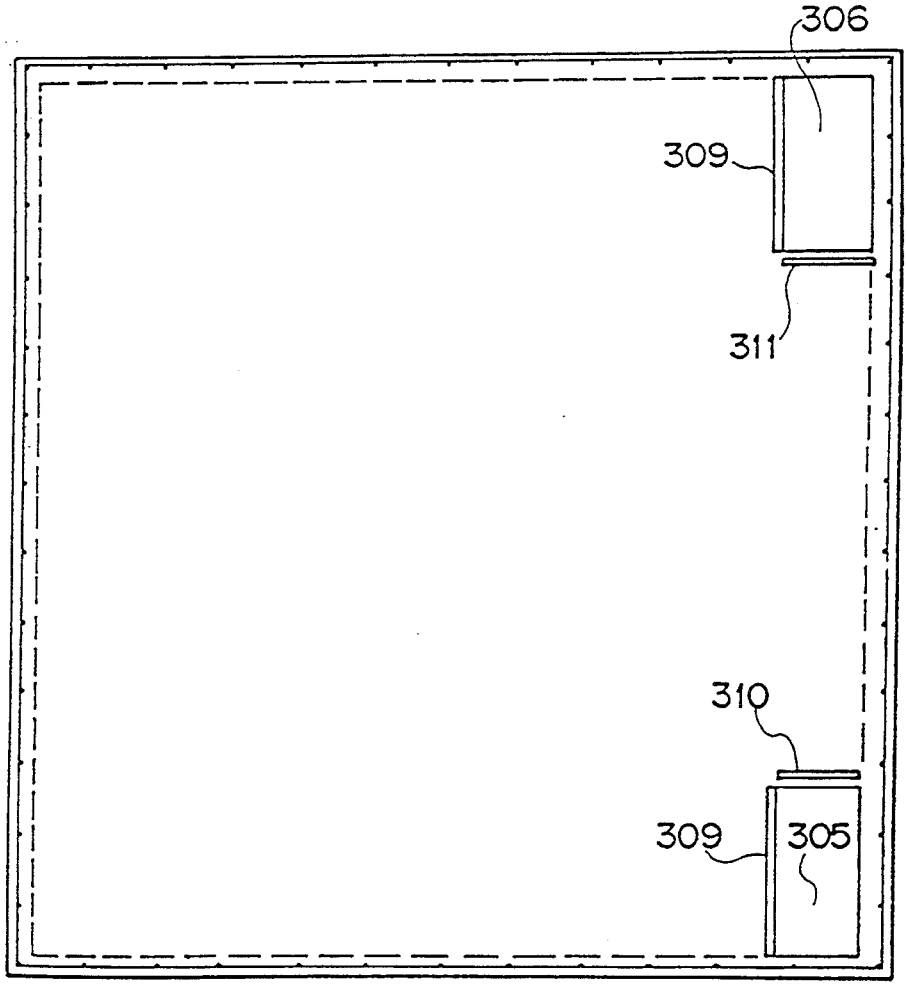

FIG. 30 shows a parking house with FIG. 31 a sectional view thereof.

Figure 32:
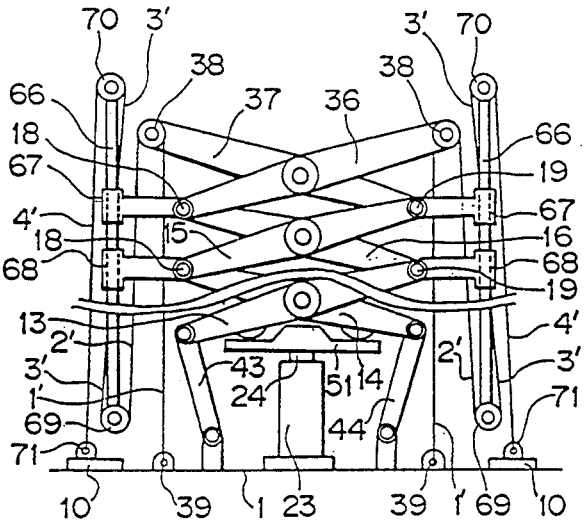
Figure 33:
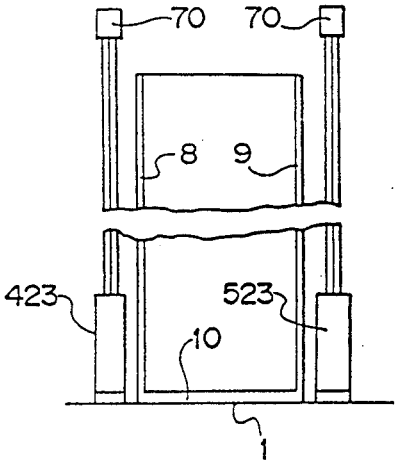
Figure 34:
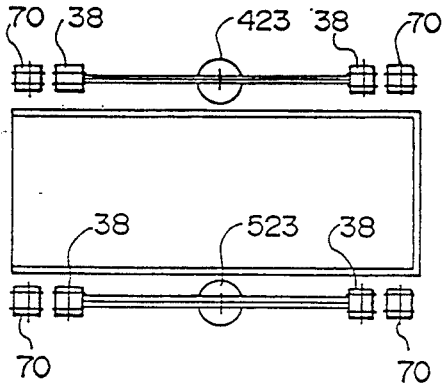
Figure 35:
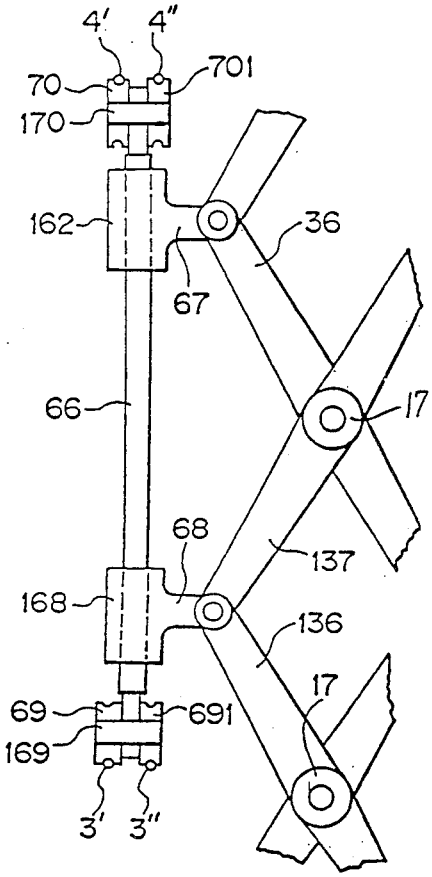
Figure 36:
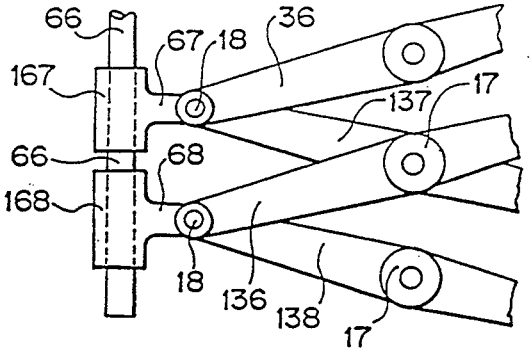

FIG. 32 illustrates another lift of the invention with FIGS. 33 and 34 showing views of FIG. 32. FIGS. 35 and 36 show details of FIG. 32.

Figure 38:
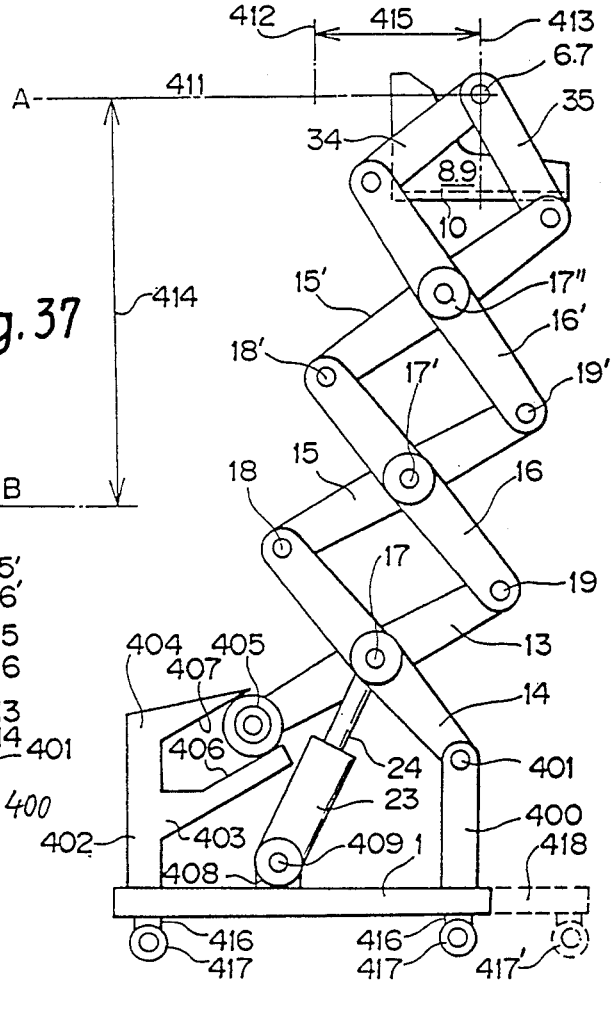
Figure 37:
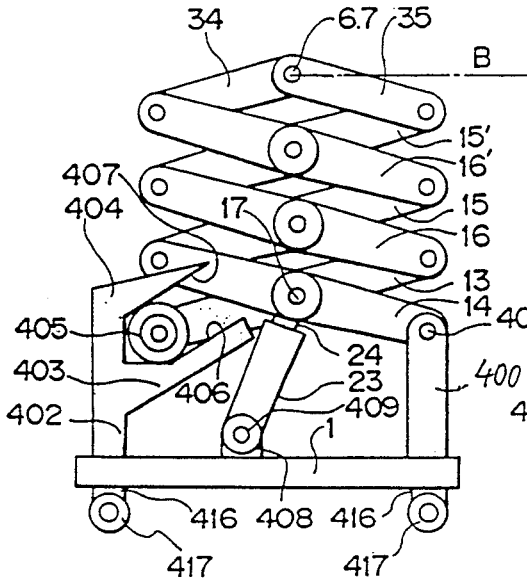
Figure 39:
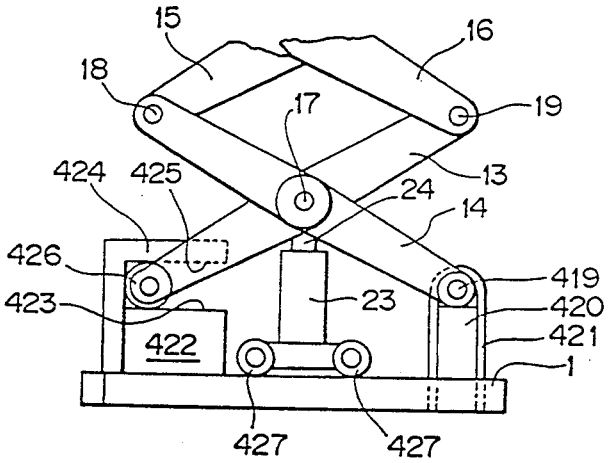

FIGS. 37 and 38 illustrate another lift of the invention in its lowest and highest locations, while FIG. 39 shows details of FIG. 37.

Figure 40:
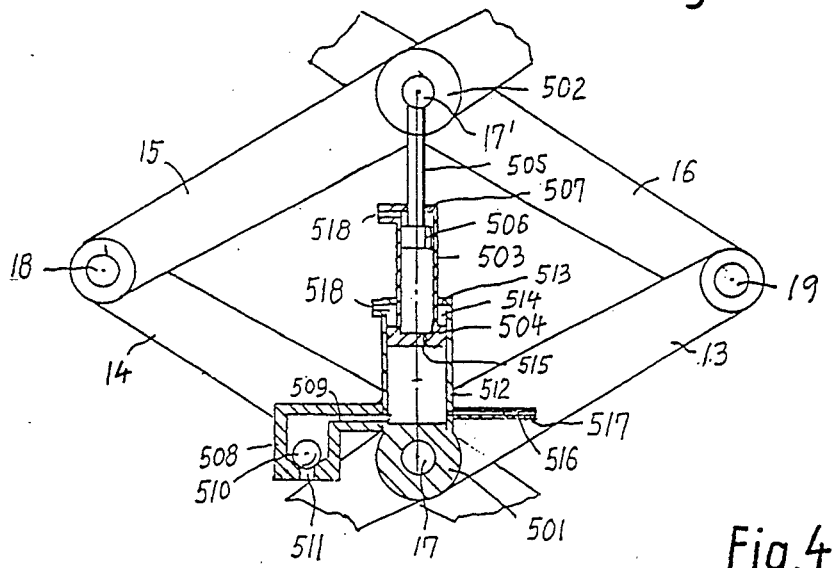
Figure 41:
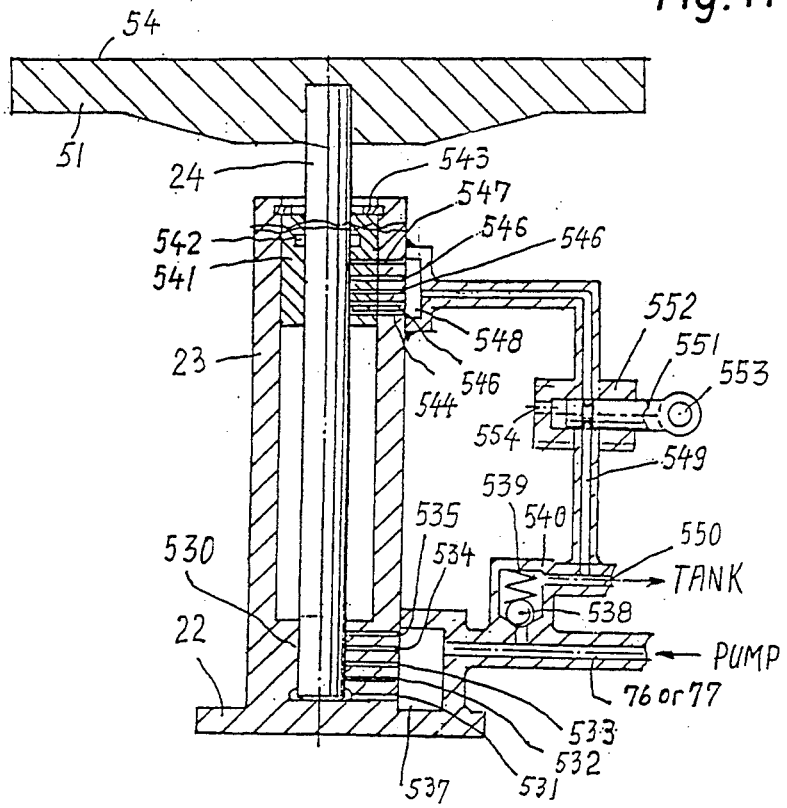
Figure 42:
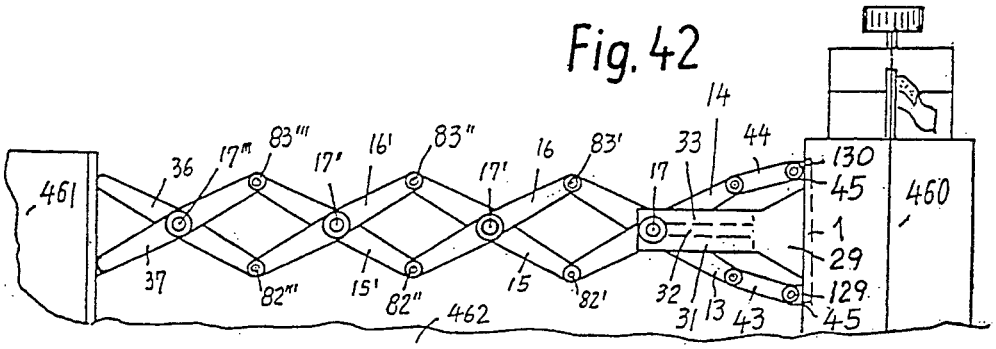

FIGS. 40 and 41 show details of different optional matters which may added to other Figures of the invention. FIGS. 40 and 41 are respective sectional views through assessory members, and;

FIG. 42 is a view from the side onto a still further embodiment of the invention.

DESCRIPTION OF THE PREFERRED EMBODIMENTS

The embodiments of the invention are applied to scissor-lifts which consist of a pluralities of scissors which are formed by shanks. The shanks 13 to 16 are swingably connected by shank connections on their ends. Each two shanks are swingably connected in their middles to form a scissor connection. In the Figures, the scissor connections are shown by referentials with end digets 17 or by referential 17, while the shank connections are shown, for example, by referentials 18 to 21. The connections may consist of bars or shafts which extend through two neighboring members to form a swing-connection. A preferred example of a swing connection is illustrated in FIG. 13.

The basic arrangement of the scissor lift, as seen in FIG. 2, has bottom feet 11,12 lowest shanks 13,14 with the scissor connection 17 in the medial portions of the shanks. The higher ends of shanks 13 and 14 are connected by shank connections 18,19 to the higher located shanks 15,16 which again form a scissor by a scissor connection 17. The highest scissor is connected by its highest ends to the top arms 34 and 35, which meet and are connected by the holder shafts 6 or 7. The described connections connect the mentioned members swingably, pivotably, in order to lift the holder shaft 6 to 7 up or to let it sink downwards. At the pivoting of the shanks, the angles "alpha" of the respective shanks, relative to the ground or bottom face 1, vary accordingly.

The first embodiment of the invention is illustrated in FIG. 1, FIG. 2 is a view onto FIG. 1 from the right, with only the scissors shown in FIG. 2. The main embodiment of the invention is the first embodiment, and consists therein, as shown in FIG. 1, that a pair of parallel to each other arranged scissor sets are set onto the plant bottom 1 with the top arms 34,35 carrying the holder shafts 6 or 7, whereon the holder 8 and 9 are borne, respectively, and which extend vertically downwards from the shafts 6,7 to bear on the lower ends the platform 10. The holders may be bars or walls, depending on design. The holders 6 and 7 may also act as swing shafts for the connection of the top arms 34 and 35. The platform 10 may with its bottom face touch or meet the top face of the bottom face or bottom plate 1 when the platform 10 is in its lowest location and the scissors have their smallest angle "alpha" relative to the ground or bottom 1.

The next embodiment of the invention is shown in FIG. 3. It is visible in FIG. 3, that the outer ends of the lowest shanks 13,14, are connected by swing-connecters 82,83 to swing the upper ends of swing arms 43,44, respectively. The swing arms 43 and 44 are with their lower ends swingably connected by swing connecters 129,130 to holders 45 on the bottom or bottom plate 1. It may be noted, that the swing connectors 129,130 are closer together than the swing connecters 82,83. The bottom face or bottom plate 1 bears in the medial portion between the holders 45 the cylinder 23 or its bottom portion 22. The piston 24 is reciprocable in the cylinder and is provided with a bearing head 25. The bearing head 25 works from below onto the scissor connecter or medial connecter 17. If now fluid is passed into the cylinder 23, the piston 23 is lifted upwards in its cylinder 23 and the bearing head 25 of the piston 23 presses against the scissor connection 17, whereby the medial portions of the respective scissor arrangement 13,14 is lifted upwards. This upwards lift effects a pivotal movement of the swing arms 43 and 44 along the arrows 47 and 49, respectively, whereby the angles "alpha" of the shanks increase and the top arms with their holder shafts 6,7 are lifted very highly upwards. The number of scissor assemblies defines the hight of the lifting stroke of the holder shafts 6,7 together with the degrees of the angles "alpha". A higher difference between "alpha-max" and "alpha min" brings a higher lift and a higher number of scissor assemblies also brings a higher lift of holder shafts 6 and/or 7. Lower differences between the "max" and "min" of the angles "alpha", as well as lower numbers of scissor arrangements, bring respectively shorter lifts of the holder shafts 6 and 7. When the piston 24 reverses its stroke, meaning that it descends in cylinder 24, the swing arms 43 and 44 pivot in the direction of the arrows 48,50 and the angles "alpha" decrease, while the holder shafts 6 and/or 7 descend. The cylinder 22 may locally be fastened with its bottom 22 to the ground face (or plate) 1 and the piston head 25 may be provided with centerers 252 to keep the pivot connection 17 at all times aligned with the center line(s) of the piston(s) 23.

The third embodiment of the invention is seen in FIG. 4. This embodiment is similar to the second embodiment, shown in FIG. 3, with the exception, that the third embodiment shown in FIG. 4, provides a piston head 25 with extensions 51 to form a long enough thrust face 54 on top of the piston head 25–51 in order to meet points or faces of a pair of lift-reception members 52 and 53 of the bottom-most shanks 13 and 14. In FIG. 4 the lift reception members are shown as rollers 52 and 53 and they are located substantially in the middle between the scissor connecters 17 and the shank connecters 82 and 83 of the shanks 13 and 14. Thereby the thrust face 51 meets points of the periphery of the rollers 52 and 53. If the rollers 52 and 53 are located half-way between the shank connecters and the scissor conneter, the scissor connecter 17 will get approximately twice the way of lift relative to the lifting stroke of the piston 24.

The fourth embodiment of the invention can become understood by the study of FIGS. 6 and 7. Therein a pair of sets of scissors is arranged parallel and adjacent of each other with a space 36 between the scissor sets for the reception of the platform 10 with its vertical holders or walls 8 and 9. The holders are borne by holder shafts 6 and 7. Below each bottom-most scissor 13,14 of the scissor sets is a cylinder-piston arrangement of FIG. 4 provided. It could, however, also be an arrangement of FIG. 3. The cylinders 23 are visible as cylinders 423 and 523 in FIG. 7. FIG. 6 is a view from the right onto FIG. 7.

Coming now to the fifth embodiment of the invention, attention is directed to FIGS. 6 to 12, which show details or the entirety of the fifth embodiment. The mentioned fifth embodiment of the invention is the provision of guide ways 31 to 33 for the vertical guide of a portion or of an arrangement to the bottom-most medial scissor connectors 17. As seen in FIGS. 9 and 10, the guide slot 32 which is bordered by the guide rails 31 and 33, is provided on holding members 29. The holding members 29 are fastened to the base face or base plate 1. They may be integral with base plate 1 and so may the guide rails 31,33 be integral with the holders 29. A respective space 30 may be provided in the members 29 for the reception of portions or the entireties of the cylinder-piston arrangements 23 to 25. So far this is clearly visible in FIG. 9. The sectional view through FIG. 9 along the arrowed line of FIG. 9 gives FIG. 10, while the sectional view along the arrowed line of FIG. 10 brings FIG. 9. In FIG. 10 it is visible that a pair of such guide arrangements 29 are provided on the ends of the base plate 1 and they are cited by referentials 429 and 529 in FIG. 10. FIGS. 11 and 12 illustrate the location of the cylinder-piston arrangements 23,24, indicated in FIG. 12 by referentials 423 and 523. FIGS. 11 and 12 show the location of the cylinder arrangements relative to the guide members 429,529.

FIGS. 6,7 and 8 illustrate the locations of the guide members 29 and of the cylinder arrangements relative to the entire assembly of the scissor sets. FIG. 8 is a view from top onto FIG. 6. The bottom-most scissor connecters 17 are provided with guide shoes 18 which engage into the guide slot 32. The shoes 18 may also be elongations of the connecting bars 17. The hight of the guide ways 31 to 33 is so dimensioned, that the bottom-most scissor connecters 17 are at their entire lengths of vertical stroke guided with their shoes or elongations 18 in the guide ways 31 to 33. That prevents the rightward- or leftward- tilting of the scissor sets, respectively to rightward and leftward in FIG. 6. If the keepers 255 of FIG. 3 are provided in the scissor sets, the guide ways and members of FIGS. 6 to 12 can occasionally be spared.

FIG. 13 illustrates an example of a scissor connection or of a shank connection in a sectional view. One finds shanks 13 and 13 provided with seats for bearings 85. A shaft 84 is extended through the radial bearings 84 and embraces with nuts 91 the axial thrust bearings 86, whereby the shanks are clamped pivotably together. Dust-protecters 92,192 as well as a distance ring 392 and nut-securers 292 may also be provided.

FIG. 14 is partially a repetition of FIG. 13, but contains in addition possibilities of the provision of guide arrangements 86 to 90. In case of presence of guide ways of FIGS. 6 to 12 the guide means 86 to 90 can be spared and only the elongated shaft 84 of FIG. 14 will then remain provided. The relative to FIG. 13 elongated shaft 84 of FIG. 14 may then extend into the guide slot 32 of FIGS. 6 to 12.

Since the main embodiments of the invention have herebefore been described, it is now suitable to mention the great features which are obtained by the embodiments of the invention. For this purpose attention is now directed to FIGS. 15 and 16 as well as to FIGS. 17 and 18.

An old house may be too week to carry the weight of an elevator in the higher portion of the house. The ceiling of the second floor of the house is indicated by referentials 98 in FIGS. 15 and 16. The bottom of the second floor, which also is the ceiling of the first floor, is shown by referentials 95 in the mentioned Figures. The ground, whereon the house is built, or the ground floor of the house is seen by referential 1, which thereby constitutes the base of the lift of the invention.

The embodiments of the invention or some of them are set onto the ground 1, for example, with base plate 1 of the embodiments. The house has no support means for hanging lifters above or on the highest flo r ceiling 98. It would also be too expensive to excavate holes into the ground below the house for the reception of lift providing cylinder-piston arrangements. In such cases the feature of the invention is, that just a single ground plate or base face 1 is to be established. All other portions of the invention are then simply borne on the base or base face 1. A complete elevator casing, cabine or housing 8,9 with platform 10 and a possible roof 92 or windows 93 can be hanged onto the holder shafts 6 and 7 of the scissor sets 4 and 5. They stand at lowest position within the room of the bottom-most floor. The carpenter may cut an hollow space 100 into the ceiling 95 of the bottom-most ceiling and thereby into the ground floor 95 of the next higher floor. He should also built walls 97 and 99 and at least one door 999 in the next higher floor to secure that no person can fall by accident into the open space 100. When now the lifters 23–25 of the embodiments of the invention are acuateted, for example, when pressure fluid is led into the cylinders 23, the top arms 34,35 lift the holder shafts 6,7 so high, that the cabine lifts into the higher floor and the platform 10 comes to rest in an equal face, aligned with the upper face of the floor 100. The door 999 can then be opened and the persons or fright can leave and enter the cabine or platform on floor 95. If the lifters 23 to 25 are sank, the platform 10 alignes again with the ground floor 1 and persons or fright can enter and leave the cabine or platform 10 on the ground floor 1.

In FIG. 17 the scissor arrangements are seen in a view from the side onto them in the down-most location, while they are seen in FIG. 18 in a similar view in their top-most location. The alignement of platform 10 with the upper floor 95 is visible in FIG. 18 and its alignement with the ground floor 1 is seen in FIG. 1.

In short, the present invention provides a self-guiding lift, which is just set onto an even ground face without any requirement of guides in the house or hall whereinto it is set. An important detail of the invention is, that the scissor sets are provided outwards of the platform or cabine and that the lifters 23–25 are mounted substantially below the lowest scissor connecters 17. Further, the drive of the lifters is synchronized, for example, by the drive and synchronization means of FIG. 5.

Another embodiment, the sixth embodiment of the invention, is the provision of a guide means for the cabin, as illustrated in FIGS. 19 to 22. FIG. 20 is FIG. 19 seen from the left side. FIG. 21 and 22 are sectional views through FIG. 19, along the arrowed line of FIG. 19.

In this embodiment of the invention, two outer faces of the cabin are provided with vertically extending guide rails 131,133 and guide ways 132 therebetween. The scissor connecters 17 of the upper-most scissors with shanks 16'',15'' have extensions 18, which engage into the guide ways 132. Thereby a swinging of the cabin is prevented. The guide rails and ways are radially short and long enough to guide just the extensions 18, as described. They thereby are only slightly longer than the up-down-strokes of a pair of scissor connections 17 is.

FIGS. 27 to 29 show that the scissor connecters 17 may have additional details. For example, guide shoes 61 around scissor connecter bars 60 and holder means 62,63. The shoes 61 are then precisely guidable on the faces 231,233 of the guide rails 31,33 while the shoes then have precise guide faces 161.

The seventh embodiment of the invention is provided only on lifts for an higher lifting stroke. This embodiment is demonstrated in FIGS. 23 to 26. It consists therein, that the upper-most shanks 37,36 are on their upper ends slightly elongated to carry thereon wire- or rope- rollers 38,39. Wires or ropes 40 are then fastened by holders 39 on the base face 1, are led over the rollers 38,39 and then extended downwards to the holders 71 on the platform 10. Thereby the lifting-stroke of the platform or of the cabin is doubled, relative to the lifting way of the upper-most shanks 36–37. When the rollers 38,3 lift one meter, the platform 10 lifts two meters etc. The arrowed lines in the Figures indicate the views onto the respective Figures to which the arrow-marks are directed.

At actual testing of the lift of the invention, it has been found, that the lift of the invention can be built so strong, that it does not lift only a few persons in a home elevator, but that in can also lift heavy weights, for example, cars, trucks or bulldozzers.

FIGS. 30 and 31 therefore illustrate the application of the lift of the invention in a multy-floor parking building. FIG. 31 shows the building of FIG. 30 as FIG. 30 is seen from above. The parking building has, for example, two lifts of the invention with platforms 10 and holders 8,9. Lift 305 may be used to lift the cars, while lift 306 may be used to let the cars down. Ground floor is shown by 301, while the second floor is shown by 302 and the third floor by 303. The openings in the floors for lifting the cars through, are 100 and 300. Doors, safety walls, fences, 308, 309,303,311,310 etc. may be provided. The lifting scissor sets are shown by 306 and 307. Referentials 304 and 305 are the walls of the parking building.

A still further embodiment of the invention is illustrated in FIGS. 32 to 36, but it is used only for very high lifting ways through many floors or to very great hights. In this embodiment some of the shanks carry guide means 67,68 for the guiding of therein provided roller holding bars 66. Long wires or ropes 4' are then fastened on the ground floor 1 by holders 39. The ropes (which may also be wires or chains) 1' go from the holders 39 upwards to and over the first rollers 38, from there down to and over the second rollers 69, from there up again to and over the third rollers 70 and from there down to the holders 71 on the platform 10. The second and third rollers are borne on the roller bearers 66, namely rollers 69 on their lower ends and rollers 70 on their higher ends. When the scissors are lifted, the shanks 15,36 also lift and the lift the guide means 67,68, while the ropes lift the roller holders 66. Finally the lower rollers 69 reach the hight of the highest portions 38 of the highest shanks, while the upper rollers 70 and the platform 10 are much higher than the highest portions of the shanks of the scissors.

FIG. 33 is the view onto FIG. 32 from the left, while FIG. 34 is a view from above onto FIG. 32. FIG. 36 shows a portion of the shanks which carry the holders in larger scale at the lowest position of them, while FIG. 35 shows the same portion of the assembly in the highest or in a higher position of the shanks and holders 66,167,168,162,57,68 etc. It should be noted, that the rollers are double rollers as seen in FIG. 35. The rollers have the rope-guide ways 3' and 3'', meaning double guide ways, because double ropes may be used to prevent accidents, if one of the ropes breaks.

As far as referentials which appear in the respective Figure, are not mentioned at the description of the respective Figure, the members which are cited by the respective referential, are known from the description of other Figures.

A specific embodiment of the invention is shown in FIGS. 37 to 39. The specificty is, that the platform or cabine ist lifted in an inclined direction relative to the verticality. It is moved up from 410 by lift 414 to position 411 and rightward from 412 by vertical direction and length 415 to position 415. FIG. 17 shows the lift in lowest position and FIG. 38 shows it in about half lifted position. This up- and right- wards effect is obtained in FIGS. 37 and 38 by fastening one end of shank 14 pivotally by 401 on holder 400, while the lower end of shank 13 is provided with a wheel or roller 405 and guided between an inclined bottom face 406 on holder 403 and an upper face 407 on holding arm 404 of holder 405. The cylinder 29 is with its bottom portion pivotably borne by 409 on holder 408. When the piston 24 lifts, the scissor connecters 17 are moved upwards and rightwards, due to the swing holder 401 and the movement of roller 405 between the guide faces 406 and 407.

A similar effect is obtained by FIG. 39. Herein the pivotable connection 419 holds shank 14, while shank 13 is with its lower end provided with the roller 426 for guidance between faces 423 and 425 on holders 424 and 422. The cylinder 23 is on its bottom provided with rollers 427 for ability to move on the bottom face 1. Swing connection 419 is by 420 and 421 fastened on bottom face 1. Lift of piston 24 provides a lift of connecters 17 and at the same time their rightward movements, which is followed by roller 426.

The bottom faces or bottom plates may be provided in most of the Figures with rollers or wheels 417 on 416, if so desired, for transportation of the lifting device on the ground.

FIG. 40 illustrates an example of a safety device for the lift of the invention. It is a piston reciprocably provided in a cylinder with the ends of piston and cylinder provided preferably between the lowest and the second lowest scissor connecters 17 and 17'. The cylinder is filled with fluid, and it is preferred to use air as the fluid. It is mostly required to use telescopic pistons 505–506 and 503–504 in double cylinders 503–512 in order to obtain the long stroke which appears between the scissor connecters 17 and 17'. Note that piston 503 may also be the cylinder in which piston 505–506 is reciprocably provided. Holder 501 connects cylinder 512 to scissor connecter 17 and holder 502 connects piston 505 to scissor connecter 17'. The piston(s) may consist of shaft(s) 505,504 and sealing piston(s) 506,504 which is (are) guided and sealed in the respective cylinder 503,512. The cylinder 512 is provided with an inlet valve 510 in valve housing 508 and connected to the lower portion of the cylinder by passage 509. The valve housing has also an inlet passage 511. The valve 510, which may be a ball, opens the inlet passage 511 if lower pressure acts in passage 511 than in housing 508 appears, and closes if the mentioned pressures are equal or if the pressure in the housing 508 is higher than the pressure in the inlet passage 511. The result thereof is, that, if the piston 504,506 moves upward, fluid, for example, air, is suctioned into the lower chamber of the respective cylinder, for example, 512. In case of telescopic arrangements as in the Figure, a passage 515 is also provided through the piston portion 504 to pass the fluid from the interior of piston 512 partially into the interior of cylinder 503. The upper portion of the cylinder(s) 512,503 has an opening 518 to permit the entering and exit of fluid into the respective upper interior portion of the cylinder.

Cylinder 512 is also provided with an outflow passage 516 of restricted cross-sectional area. The outflow passage may be the interior of a small diameter pipe or hose of a long length. The small cross-sectional area and/or length of the outlet passage 516 limits the outflow quantity which can flow out of the interior of the cylinder(s). Thereby the outflow passage 516 acts as a brake and restricts the maximum of the downward speed of the piston(s). The cabine or platform of the lift can thereby never run downwards with a too fast speed. Accidents are thereby prevented. Note, hower that the cross-sectional area of passage 516 must be very small or the pipe, hose, 517 must be very long to secure enough resistance to the outflowing fluid, like air. At the downward stroke of the piston (s) the inlet valve 510 is closed, due to the higher pressure in housing 508. At the upwards stroke of the piston(s) the interior(s) of the cylinder(s) provide lower pressure in housing 508 and thereby open the valve 510 to fill the interior(s) of the cylinder(s) with air or fluid.

FIG. 41 shows a speed-variator device incorporated in the lifting device. Cylinder 23 has here not only the upper guide bush 541 for the guidance of piston 24, but also a bottom guide 530 into which the piston 24 can enter during a portion of its stroke. The lower piston guide portion 530 seals around the respective portion of piston 23 and is provided with a plurality of inlet passages 531 to 535 which are located, axially above each other respective to the cylinder 23 and piston 24. Inlet passage 76 or 77 is provided with an overload valve 538,539 and with a chamber 537 which communicates to the mentioned inlet passages 531 to 535. If the pump is actuated, only passage 531 is open, while passages 632 to 535 are closed by the fitting piston 24. Piston 24 receives thereby only a small fraction of the fluid which is supplied by the pump, while the largest portion of the mentioned fluid is passed over the valve 538, which may be loaded by spring 549 through passage 550 back to the tank. As soon as the piston is moved so far upwards, that passage 532 is opened, a larger quantity of fluid acts against the piston and increases its speed, while the overflow quantity of fluid through valve 538 is reduced. When the upwards movement of the piston opens also passages 533,534 and 535 successively, the piston increases its upwards speed to reach its maximum of speed as soon as passage 535 is opened. The overflow through the valve 538 is then "zero". By this system a sudden start of the piston is prevented and a smooth starting with gradually increasing speed is obtained.

When the piston nears the upper portion of its stroke, the outlet passages 544 to 547 are gradually, one after the other, are opened by the piston and fluid can then escape through chamber 548 and through fluid lines 549 and/or 550 to the tank. The upwards speed of the piston thereby slows gradually down to a smooth stop in its uppermost location. The upper bush 541 may be kept by holder 543 in cylinder 23 and it may also contain a seal 542. To prevent a sinking of the cabine or platform at undesired times, a closure device may become provided in passage 549. This closure device may be operated by remote control and may consist of a fitting piston 551 in a respective housing or bush 552. Closure device 551 may be a connecter 553 and housing 552 may have an unloading passage 554, or the entire closure device may be a pivoting valve.

When the piston 24 nears its lowest portion of its downwards stroke it enters guide-and seal- portion 530 and closes the passages 535 to 531 one after the other in succession. Thereby these passages act as outflow stopper passages to gradually reduce the downwards speed of the piston until only passage 531 remains open and the piston sets with a very low speed onto the bottom of the cylinder 23.

Instead of using the device of the invention as a vertical lift, it may also be used as a vertical tracting- or sinking-device by mounting the base plate 1 on the ceiling of a hall, a crane, or the like. Note in this respect, that the holders 45 of the respective Figures are hold and fastened on the base plate 1. If now base plate 1 becomes fastened on the bottom face of a ceiling, the apparatus can tract upwards, if a double acting piston is used in a double acting cylinder. That means a double=-both ways - acting piston 24 in double acting cylinder 23.

It is similarly possible to mount the device horizontally and to use it as a pusher, as an accelerator or as a tracting device.

A sample of a horizontally mounted lift with stroke multipliers of the invention is illustrated in FIG. 42, by way of an example.

In FIG. 42 the base plate 1 is set vertically on the wall of a ship 460, which floats on the surface of the water 462. The ship was close to the pier 461, when it became loaded or unloaded. Commonly a tug-boat tracts it away from the pier 461, because the ship must be away from the pier before its propeller can become started. The ship of FIG. 42., however, does not need any tugboat, because it uses its stroke multiplying device of the invention to trust the ship 460 away from the pier 461. In the Figure the scissor sets have reached about their maximum of angle and stroke. The ship is now already far away from the pier 461. The stroke multipliers of the invention can now become retracted and the ship can start its propeller to run thereafter by own power. The device might also be mounted in opposite direction, meaning mounted on the vertical wall of the pier 461 to tract incoming ships to the pier and to thrust leaving ships away from the pier 461. One sees in the Figure the holders 45, the base plate 1, the base swing holders 129,130, the guide way 31–33 on guide body 29, the respective scissor shanks 13,14,15,16, the medial scissor connecters 17 and the outer swing connecters 82,83 of the respective earlier described Figures.

Similar arrangements as in FIG. 42 may also be utilized for rescue of persons or matters which have fallen into the sea, for fire fighting and the like. It may also be mounted outside on vertical walls of houses, on cars and the like, and it may also be mounted under an angle, inclined, between vertical- and horizontal- traction or pushing, lifting or sinking etc. It may also be utilized as accelerator for rockets, balls, stones, vehicles, and the like.

What is claimed is:

1. A stroke guiding, lift- and sink- strokes providing assembly, comprising, in combination, a stroke provider, a stroke-guide and at least one stroke-multiplyer, with said stroke multiplyer provided by at least one scissor with said scissor consisting of a pair of medially by a medial connecter 17 swingably connected shanks 13,14;

wherein a base face 1 bears and holds a lift-stroke provider 23–24, holder portions 29 and base-connecters 129,130;

wherein said stroke provider has a stationary member 23 and a thereon reciprocable, lifting strokes and sinking strokes providing, stroker-member 24, with said stationary member being borne and kept by said base face, wherein said shanks of said scissors have outer ends which form outer connecter portions, wherein swing arms 43,44, which form on their ends complementary connecter portions, are provided between the lowest located ends of said shanks and said base connecters, wherein one of said complementary connecter portions of the respective swing arm of said swing arms is swingably connected to the respective base connecter of said base connecters why the other of said complementary connecter portions of the respective swing arm of said swing arms is swingably connected to the lowest outer connecter of said outer connecters of said shanks, wherein the head of said reciprocable stroker-member at least indirectly meets the adjacent scissor with the meeting place of said stroking member with said scissor located between said ends of said shanks, and;

wherein said holder portions form guide rails 31–33 which extend perpendicular to said base face and have a length which slightly exceeds the length of the lifting stroke of said strokes and which are located suitably to at all times embrace at least indirectly a portion of said medial connecter.

2. The device of claim 1, wherein said head 25 of said stroker-member 24 meets said medial connecter 17,18 and said stationary member 23 is located below said medial connecter 17,18, but above said base face.

3. The device of claim 1, wherein said head of said stroker-member 24 forms lateral extensions 51, wherein said shanks 13,14 form between said outer ends and said medial connecters 17,18 rollers 52 facilitating locations, and, wherein rollers 52,53 are provided at said rollers facilitating places to bear loads which appear at least temporarly between said head 51 and said shanks 13,14.

4. A synchro-lift assembly with lifting- and sinking-strokes providing lifters and stroke-multiplyers, comprising, in combination, a pair of lifts which are arranged laterally parallel of each other and which include strokes providing lifters and stroke multiplying scissor shanks in each of saids lifts, wherein bottom-most swing arms 43,44 are swingably provided with their lower ends on holders 129,130 of a base face 1 and connected with their upper ends to the lowest outer ends 82,83 of the lowest of said shanks 13,14 of the lowest of said scissors, wherein said scissors are formed by medial scissor connections 17 which swingably connect the respective shanks 13,14, while lifting devices 22–25, which contain portions of said lifters, are provided between said base face and said lowest scissors;

wherein synchronization means (f.e. 73 to 77) are provided to each of said lifting devices (423–425 and 523–525) to move their lifters (424,524) in unision, wherein sets of scissors 4,5 are arranged laterally of each other with a space between said sets, said lifting devices are located below the lowest scissors of said scissors and act against said lowest scissors, while the highest shanks of said shanks connect their upper ends with swingably provided connections 20,21 to upper arms 34,35, which arms meet with their other ends to carry holders 6,7;

wherein carriers 8,9 which are borne on said holders 6,7 to extend downwards from said holders over and beyond said scissors to hold on their lower ends a platform 10, whereby said carriers and said platform are located in said space between said scissors while said platform is close to said base face at times when said lifters are in their lowest positions, and, wherein said scissors form said stroke multiplyers and act as stroke multiplyers to multiply the strokes of said holders 6,7 and of said platform 10 relative to the said strokes of said lifters of said lifting devices.

* * * * *